US006527587B1

(12) United States Patent
Ortega et al.

(10) Patent No.: US 6,527,587 B1
(45) Date of Patent: Mar. 4, 2003

(54) HEADER ASSEMBLY FOR MOUNTING TO A CIRCUIT SUBSTRATE AND HAVING GROUND SHIELDS THEREWITHIN

(75) Inventors: Jose L. Ortega, Camp Hill, PA (US); Stuart C. Stoner, Lewisberry, PA (US); Alan Raistrick, Rockville, MD (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/302,027

(22) Filed: Apr. 29, 1999

(51) Int. Cl.[7] ..... H01R 13/648
(52) U.S. Cl. ..... 439/608
(58) Field of Search ..... 439/608, 108, 439/101, 607

(56) References Cited

U.S. PATENT DOCUMENTS

| | | | | |
|---|---|---|---|---|
| 4,157,612 A | * | 6/1979 | Rainal | |
| 4,601,527 A | | 7/1986 | Lemke | 339/14 R |
| 4,686,607 A | | 8/1987 | Johnson | 361/413 |
| 4,737,116 A | * | 4/1988 | Slye et al. | 439/608 |
| 4,975,084 A | | 12/1990 | Fedder et al. | 439/608 |
| 5,174,770 A | | 12/1992 | Sasaki et al. | 439/108 |
| 5,197,893 A | | 3/1993 | Morlion et al. | 439/101 |
| 5,310,354 A | * | 5/1994 | Oswald, Jr. | 439/108 |
| 5,507,655 A | * | 4/1996 | Goerlich | 439/608 |
| 5,588,851 A | | 12/1996 | Morlion et al. | 439/108 |
| 5,620,340 A | * | 4/1997 | Andrews | 439/608 |
| 5,660,551 A | | 8/1997 | Sakurai | 439/108 |
| 5,664,968 A | | 9/1997 | Mickievicz | 439/608 |
| 5,775,947 A | * | 7/1998 | Suzuki et al. | 439/608 |
| 5,813,871 A | * | 9/1998 | Grabbe et al. | 439/108 |
| 5,842,887 A | | 12/1998 | Andrews | 439/608 |
| 6,053,751 A | * | 2/1999 | Humphrey | 439/108 |
| 6,129,555 A | * | 10/2000 | Daikuhara et al. | 439/608 |

FOREIGN PATENT DOCUMENTS

EP 0 907 225 A2 9/1998

OTHER PUBLICATIONS

Fusi, M.A. "Differential Signal Transmission Through High Speed Interconnects", Publication Date Unknown, 73–78, No Date.

* cited by examiner

*Primary Examiner*—Neil Abrams
(74) *Attorney, Agent, or Firm*—Woodcock Washburn LLP

(57) ABSTRACT

A header assembly is mounted to a backplane and receives a complementary electrical connector. The header assembly has an insulating shroud having a base with backplane and connector sides and a primary edge, and differential signal pin pairs, ground shields, and ground pins mounted to the base. The signal pin pairs are arranged into rows extending in a first direction along the base and along the base primary edge, and columns extending in a perpendicular second direction along the base. The signal pins in each pair are adjacently arranged into a sub-row extending in the first direction. Each signal pin in a pair has an inner side facing the other pin in the pair, an opposing outer side, and primary and non-primary sides facing toward and away from the base primary edge, respectively. One ground shield is associated with each signal pin. Each ground shield extends through the base between the connector side and the backplane side, and includes first and second attached wings arranged at right angles. The first wing extends along the first direction adjacent and along either the primary or non-primary side of the associated signal pin, and the second wing extends along the second direction adjacent and along the outer side of the associated signal pin. The ground shields in combination substantially electromagnetically isolate within the base each signal pin pair from all others. Each ground pin electrically contacts at least one ground shield at the second wing thereof.

17 Claims, 8 Drawing Sheets

HEADER ASSEMBLY FOR MOUNTING TO A CIRCUIT SUBSTRATE AND HAVING GROUND SHIELDS THEREWITHIN

CROSS-REFERENCE TO RELATED APPLICATION

This application contains subject matter related to the subject matter disclosed in U.S. patent application Ser. No. 08/942,084, filed Oct. 1, 1997, and now abandoned and entitled CONNECTOR FOR ELECTRICAL ISOLATION IN A CONDENSED AREA; U.S. patent application Ser. No. 09/045,660, filed Mar. 20, 1998, now U.S. Pat. No. 6,227,882 and entitled CONNECTOR FOR ELECTRICAL ISOLATION IN A CONDENSED AREA; and U.S. patent application No. Ser. 09/295,504, filed Apr. 21, 1999 now U.S. Pat. No. 6,116,926, and entitled CONNECTOR FOR ELECTRICAL ISOLATION IN A CONDENSED AREA, each of which is hereby incorporated by reference.

FIELD OF THE INVENTION

The present invention relates to a header assembly for mounting to a circuit substrate and for receiving a complementary electrical connector. In particular, the present invention is for a high density header assembly for use in, for example, a motherboard in a backplane/back panel application.

BACKGROUND OF THE INVENTION

In a typical electrical interconnection system, a first removably insertable circuit board includes a complementary electrical connector that is to be mated with a header assembly or header which is mounted to a second circuit board. As should be understood, when the first circuit board is coupled to the second circuit board by way of the electrical connector and header and when the first circuit board is in operation, a number of signals enter or leave the first circuit board through conductive paths defined by the electrical connector on the first circuit board and the header on the second circuit board. In many instances, the second circuit board has other circuit boards coupled thereto by other respective headers and complementary electrical connectors, and the aforementioned signals can originate from or be destined for such other circuit boards. Of course, the aforementioned signals can also originate from or be destined for other locations remote from the second circuit board by way of appropriate interconnections.

If it is desirable to suppress signal noise and/or crosstalk, it is known that a signal may be transmitted over a pair of differential (positive and negative) signal lines that travel together in close proximity. Typically, in such pair of differential lines, the signal itself (+V) is transmitted on the positive line, and the negation of the signal (−V) is transmitted on the negative line. Since both lines travel together in close proximity, any noise encountered by the lines should appear in a generally identical form on both lines. Accordingly, the subtraction (by appropriate circuitry or other means) of the negative line (−V+noise) from the positive line (+V+noise) should cancel out such noise ((+V+noise)−(−V+noise)=2V), thus leaving the original signal, perhaps with a different amplitude.

Oftentimes, in a high frequency environment, most every signal passing to and from a circuit board travels as a pair of differential signals on a pair of differential signal lines. Accordingly, the electrical connector on the circuit board and the header on the backplane must accommodate all such pairs of differential signal lines. Moreover, with increased contact density on a circuit board, there has been a corresponding increase in signal lines associated with such circuit board. As a result, the number of individual lines running through the electrical connector of the circuit board and the associated header can be quite large. At the same time, since it is desirable to increase the number of circuit boards that can be coupled to the backplane, the 'real estate' on the backplane used by the header must be kept small. Therefore, the 'density' of individual signals that pass through the electrical connector and header must be increased.

With such increased density, however, the issue of susceptibility to noise and/or crosstalk again arises, even in electrical connectors and headers that transmit pairs of differential signals. To combat such density-based noise, the header in particular has been modified to include ground shielding which substantially electromagnetically isolates within the header each pair of differential signal lines from every other pair of differential signal lines.

Accordingly, a need exists for a header that can have multiple differential signal pairs in relatively high density, and that has ground shielding for the signal pins, where the header is practical and relatively easily manufactured.

SUMMARY OF THE INVENTION

The present invention satisfies the aforementioned need by providing a header assembly for being mounted to a circuit substrate such as a backplane and for receiving a complementary electrical connector secured to a daughterboard. The header assembly has an insulating shroud, a plurality of signal pins, a plurality of ground shields, and a plurality of ground pins, all mounted to the base of the shroud.

Such base has a backplane side for facing toward the backplane, a connector side for facing toward the mating connector, and a primary edge. The signal pins are arranged into a plurality of rows extending in a first direction along the base and along the primary edge of the base, and a plurality of columns extending in a second direction along the base generally perpendicular to the first direction. In differentially paired signal pins, such signal pins in each pair are adjacently arranged into a sub-row extending in the first direction. Each signal pin in a pair has an inner side facing toward the other pin in the pair, an outer side opposite the inner side, a primary side extending between the inner side and the outer side and facing toward the primary edge of the base, and a non-primary side extending between the inner side and the outer side and facing away from the primary edge of the base.

One ground shield is associated with each signal pin. Each ground shield generally extends through the base between the connector side and the backplane side, and includes first and second attached wings arranged at about right angles. The first wing extends generally along the first direction adjacent and along one of the primary side and the non-primary side of the associated signal pin, and the second wing extends generally along the second direction adjacent and along the outer side of the associated signal pin. The plurality of ground shields in combination substantially electromagnetically isolate within the base of the shroud each pair of signal pins from every other pair of signal pins. Each ground pin electrically contacts at least one ground shield at the second wing thereof.

BRIEF DESCRIPTION OF THE DRAWINGS

The foregoing summary, as well as the following detailed description of preferred embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF PREFERRED EMBODIMENTS

Figure 1:
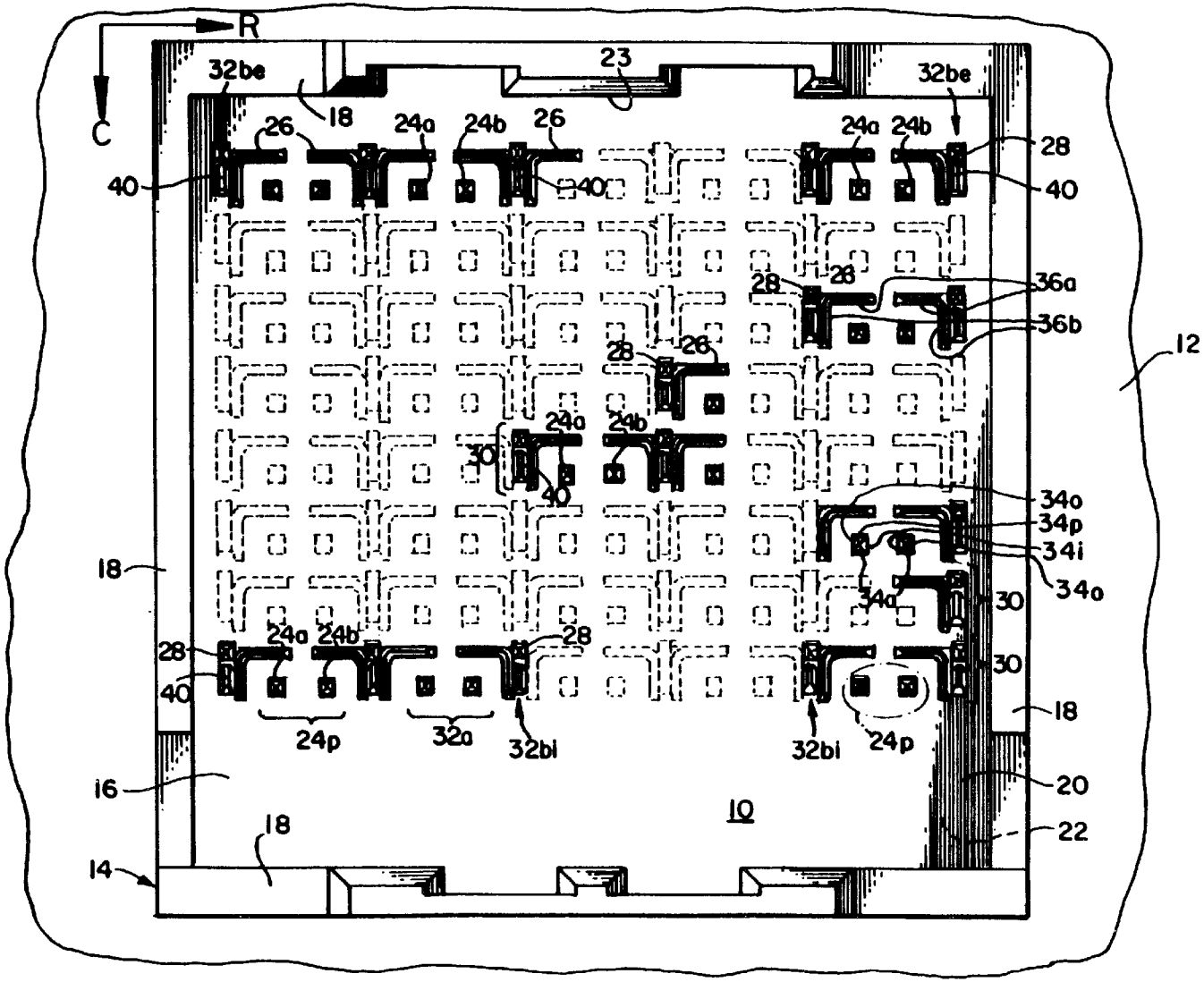
FIG. 1 is a plan view of a connector side of a header in accordance with one embodiment of the present invention, and shows such header mounted to a backplane.

Certain terminology may be used in the following description for convenience only and is not considered to be limiting. The words "left", "right", "upper", and "lower" designate directions in the drawings to which reference is made. The words "inwardly" and "outwardly" are further directions toward and away from, respectively, the geometric center of the referenced object. The terminology includes the words above specifically mentioned, derivatives thereof, and words of similar import.

Referring to the drawings in detail, wherein like numerals are used to indicate like elements throughout, there is shown in FIG. 1 a header assembly or header 10 in accordance with one embodiment of the present invention. As seen, the header 10 is mounted to a circuit substrate such as a backplane 12 in a position to receive a complementary electrical connector (not shown) on a circuit board (not shown) to be coupled to the backplane 12 by way of the electrical connector and header 10.

As seen, the header 10 includes an insulating shroud 14 which has a base 16. As should be understood, when the header 10 is mounted to the backplane 12, the base 16 of the shroud 14 of the header 10 is generally parallel to such backplane 12. Typically, although not necessarily, the shroud 14 of the header 10 also has walls 18 that extend away from the base 16 at generally right angles thereto. Accordingly, the walls 18 form a well within which the electrical connector is inserted while mating to the header 10. Typically, the walls 18 align and guide the electrical connector as it is being inserted so as to ensure a proper connection and so as to prevent damage that may occur from mis-alignment. The walls 18 may include one or more keying elements (the slots shown, for example) that mate to corresponding keying elements in the electrical connector to further ensure a proper connection and for polarization.

As should be understood, and as seen in FIG. 1, the base 16 of the shroud 14 has a connector side 20 that faces toward the mating connector, and a backplane side 22 that faces toward the backplane 12. The base 16 of the shroud 14 also has a primary edge 23, which as will be explained below is designated as such for purposes of being a fixed reference in the present disclosure. As seen in FIG. 1, the primary edge 23 runs along the top of the base 16.

Header 10 includes signal contacts, ground contacts, and ground shields. In a differential pair application such as that shown in FIG. 1, the header 10 has a plurality of pairs 24*p* of differential signal pins 24*a*, 24*b*, a plurality of ground shields 26, and a plurality of ground pins 28. As should be understood, for purposes of clarity, only a few of the elements 24*a*, 24*b*, 24*p*, 26 and 28 are shown in detail, while the remainder of such elements are shown in phantom. As seen, each pair 24*p* of signal pins 24*a*, 24*b*, each ground shield 26, and each ground pin 28 is mounted to the base 16 of the shroud 14. Each signal pin 24*a*, 24*b* and each ground pin 28 extends away from the base 16 from both the connector side 20 and the backplane side 22 in opposing directions generally perpendicular to such base 16, as can be seen in and/or appreciated from FIGS. 1–4.

As can be seen in FIG. 1, the pairs 24*p* of signal pins 24*a*, 24*b* are arranged into a plurality of rows 30 extending in a first direction (as indicated by the arrow R) along the base 16 and along the primary edge 23 of the base 16. That is to say, the rows 30 and the first direction run along the surface of the base 16, and generally parallel to the primary edge 23. Additionally, the pairs 24*p* of signal pin 24*a*, 24*b* are further arranged into a plurality of columns 32*a* that extend in a second direction (as indicated by the arrow C) along the base 16 generally perpendicular to the first direction. Again, that is to say, the columns 32*a* and the second direction run along the surface of the base 16, and generally perpendicular to the primary edge 23. To summarize, then, the pairs 24*p* of signal pins 24*a*, 24*b* are arranged generally rectilinearly.

Still referring to FIG. 1, the signal pins 24*a*, 24*b* in each pair 24*p* are adjacently arranged into a sub-row that extends in the first direction (arrow R). Accordingly, each row 30 has X pairs 24*p* of signal pin 24*a*, 24*b* and 2X individual signal pins 24*a*, 24*b*. Correspondingly, each column 32 has Y pairs 24*p* of signal pins 24*a*, 24*b*, and 2Y individual signal pins 24*a*, 24*b*.

Figure 2:
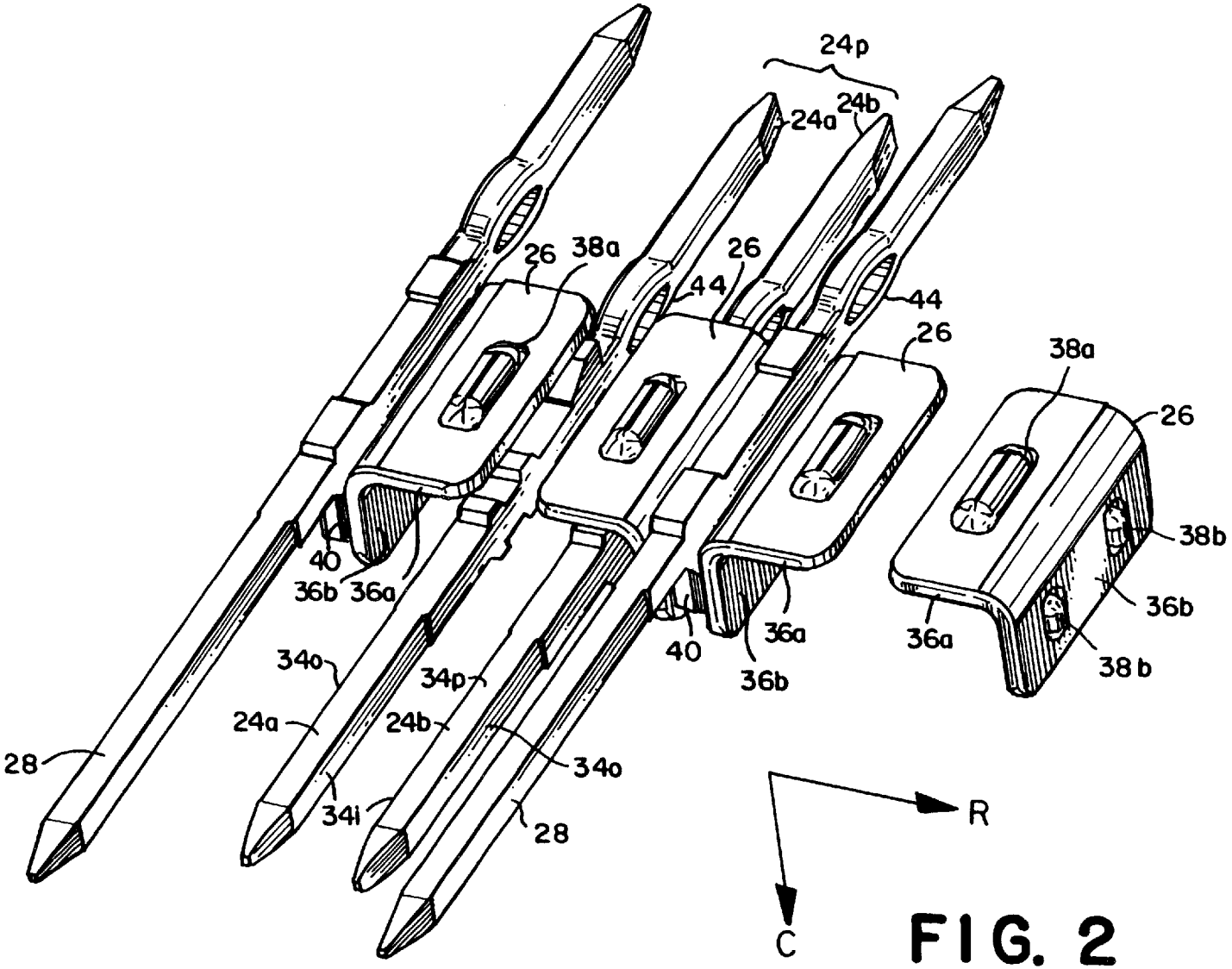
FIG. 2 is a perspective view of a portion of the pins and ground shields of the header of FIG. 1, with the shroud of FIG. 1 removed for clarity.
Figure 3:
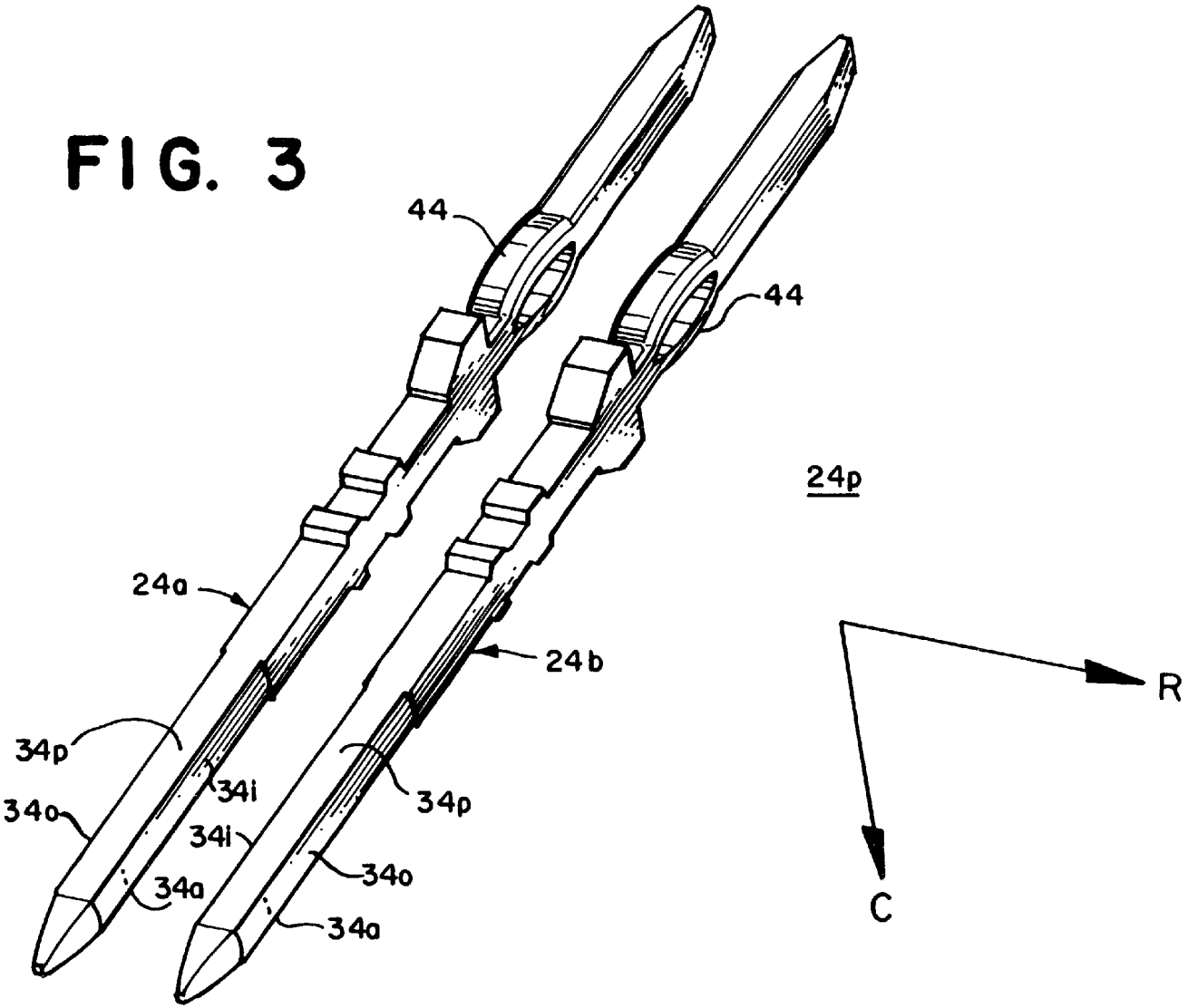
FIG. 3 is the same perspective view of FIG. 2, but shows only the pair of differential signal pins of FIG. 2.

As seen in FIGS. 1–3, each signal pin 24*a*, 24*b* in a pair 24*p* has an inner side 34*i* that faces toward the other signal pin 24*a*, 24*b* in the pair 24*p*, an outer side 34*o* opposite the inner side 34*i*, a primary side 34*p* that extends between the inner side 34*i* and the outer side 34*o* and that faces toward the primary edge 23 of the base 16, and a nonprimary side 34*a* that extends between the inner side 34*i* and the outer side 34*o* and that faces away from the primary edge 23 of the base 16.

Each signal pin 24*a*, 24*b* (and each ground pin 28 as well) as shown in the drawings is generally rectilinear in transverse cross-section, and accordingly the sides 34*i*, 34*o*, 34*p*, 34*a* of each signal pin 24*a*, 24*b* (and the sides of each ground pin 26) are generally flat as shown. However, it will be appreciated that the signal pins 24*a,* 24*b* (and the ground pins 26) can have other configurations in transverse cross-section, including but not limited to circular, oblong, and multi-sides other than four. Nevertheless, the sides 34*i,* 34*o,* 34*p,* 34*a* of each signal pin 24*a,* 24*b* as designated above are still applicable even if such sides do not correspond to flat surfaces in transverse cross-section.

Although the present invention is described in terms of pairs 24*p* of differential signal pins 24*a,* 24*b,* it will be recognized that other arrangements or types of signal pins may be employed without departing from the spirit and scope of the present invention. For example, and depending on the particular application, the signal pins may be individually grouped (in a single-ended arrangement), or may be grouped into threes, fours, fives, etc.

Figure 4:
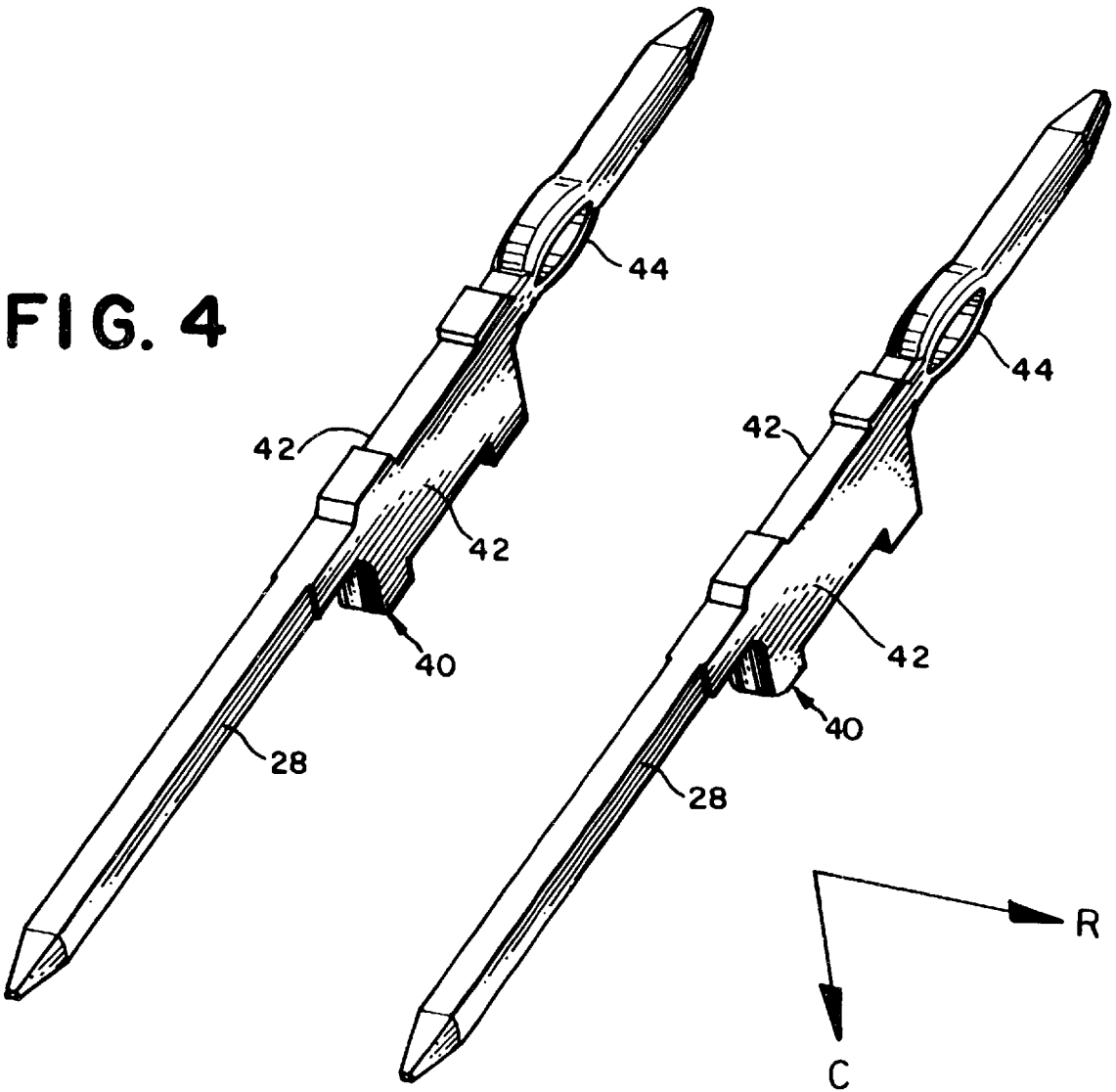
FIG. 4 is the same perspective view of FIG. 2, but shows only the ground pins of FIG. 2.
Figure 5:
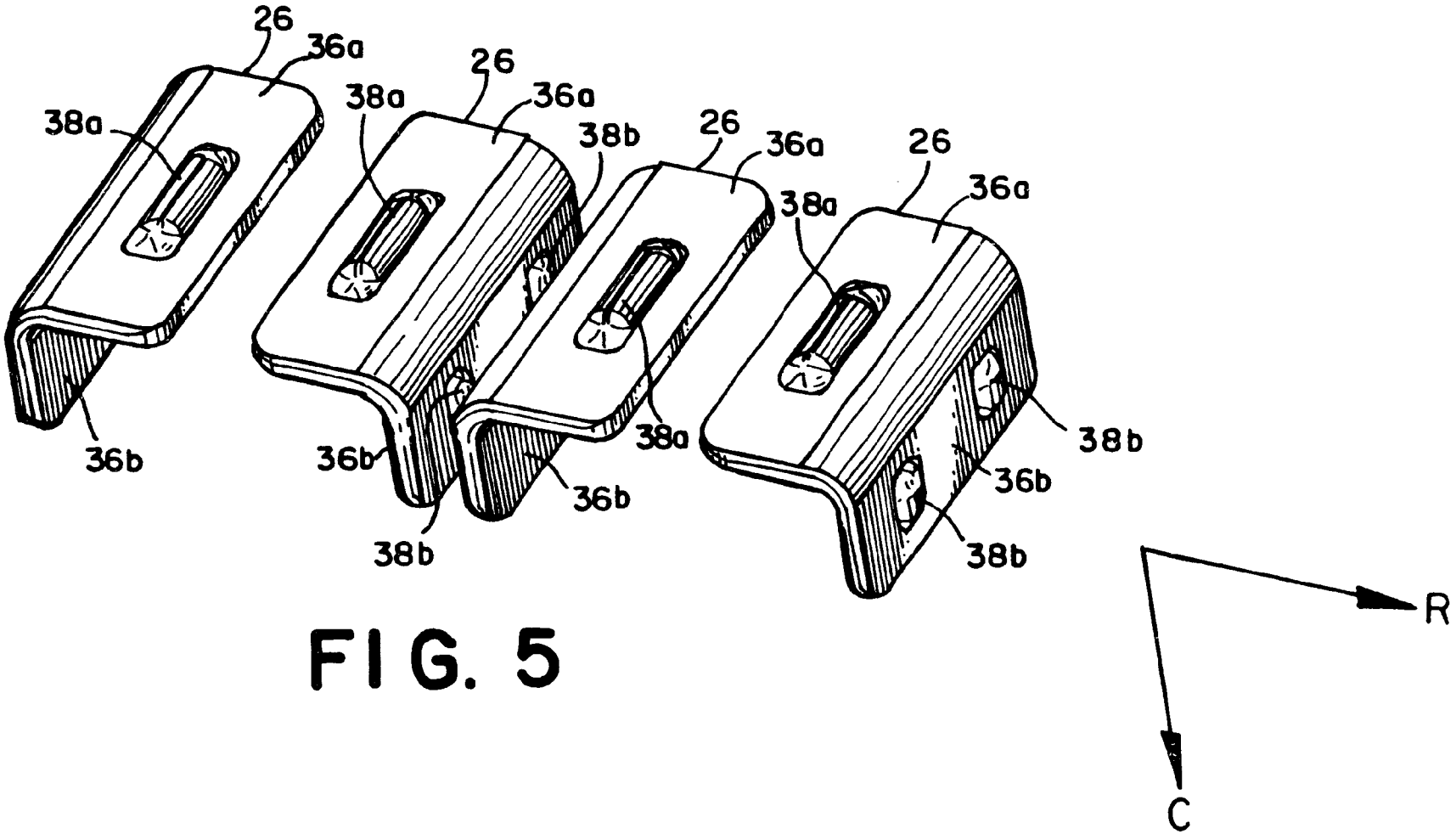
FIG. 5 is the same perspective view of FIG. 2, but shows only the ground shields of FIG. 2.

Referring now to FIGS. 1, 2, and 5, in the embodiment of the present invention shown, at least one ground shield 26 is associated with each signal pin 24*a,* 24*b.* Preferably, each ground shield 26 generally extends through the base 16 between the connector side 20 and the backplane side 22, and more preferably from about the surface of the connector side 20 to about the surface of the backplane side 22. Accordingly, each ground shield 26 preferably has a depth that generally corresponds to a thickness of the base 16 of the shroud 14. As a result, though not shown in FIGS. 2–5, it should be apparent where the base 16 of the shroud 14 is positioned in relation to the signal pins 24*a,* 24*b,* ground shields 26, and ground pins 28.

Preferably, each ground shield is generally L-shaped and includes first and second attached wings 36*a,* 36*b* that are arranged at about right angles with respect to each other. The first wing 36*a* of each ground shield 26 may extend generally along the first direction (arrow R) adjacent and along the primary side 34*p* or the non-primary side 34*a* of the associated signal pin 24*a,* 24*b.* Of course, to achieve shielding of each pair 24*p* of signal pins 24*a,* 24*b,* it is necessary that some order be provided with regard to which side (primary 34*p* or non-primary 34*a*) each first wing 36*a* extends. As but one example, each ground shield 26 associated with a signal pin 24*a* (to the left in FIG. 1) may extend along the primary side 34*p* thereof, and each ground shield 26 associated with a signal pin 24*b* (to the right in FIG. 1) may extend along the non-primary side 34*a* thereof Preferably, the first wings 36*a* of all the ground shields 26 extend adjacent and along one or the other of the primary side 34*p* and the non-primary side 34*i* of the respective associated signal pins 24*a,* 24*b.* As shown, the first wings 36*a* of all the ground shields 26 extend adjacent and along the primary side 34*p* of the respective associated signal pins 24*a,* 24*b.* However, and as was discussed above, in certain circumstances an alternate arrangement may be useful.

As seen in FIGS. 1, 2, and 5, the second wing 36*b* of each ground shield 26 generally extends along the second direction (arrow C) adjacent and along the outside 34*o* of the associated signal pin 24*a,* 24*b.* With the plurality of ground shields 26 thus arranged with respect to the pairs 24*p* of signal pins 24*a,* 24*b,* then, and as best understood by viewing FIG. 1, the plurality of ground shields 26 in combination substantially electromagnetically isolate within the base 16 of the shroud 14 each pair 24*p* of signal pins 24*a,* 24*b* from every other pair 24*p* of signal pin 24*a,* 24*b.*

Preferably, for each pair 24*p* of signal pins 24*a,* 24*b,* the first wings 36*a* of the associated ground shields 26 extend toward each other and reside generally in a single plane. Preferably, such first wings 36*a* do not actually contact each other, and the distal end of each second wing 36*b* does not extend so far as to directly contact another ground shield 26. Accordingly, portions of the material forming the base 16 separate the ground shields 26 from one another, and in doing so provide structurally integrity to such base 16. Due to the lack of direct connections between ground shields 26, and as can be appreciated from FIGS. 1, 2, and 5, unshielded gaps exist between the ground shields. Such gaps should be minimized so that the pairs 24*p* of signal pins 24*a,* 24*b* are adequately shielded.

As shown in FIG. 1, except for the pairs 24*p* in the bottom-most row 30, each pair 24*p* of signal pins 24*a,* 24*b* is substantially surrounded on all sides by ground shields 26. In particular, the outer sides 34*o* and primary sides 34*p* of the signal pins 24*a,* 24*b* are substantially surrounded by the first and second wings 36*a,* 36*b* of the associated ground shields 26, and the non-primary sides 34*a* of the signal pins 24*a,* 24*b* are surrounded by the ground shields 26 associated with the pair 24*p* of signal pin 24*a,* 24*b* immediately below. Since differential pairing is used, shielding between each signal pin 24*a,* 24*b* in each pair 24*p* is not believed to be necessary. If a single-ended arrangement is used, however, shielding between each row of signals may be used. The pairs 24*p* of signal pin 24*a,* 24*b* in the bottom-most row do not have shielding in the direction of the non-primary sides 34*a*. However, no other signal pins 24*a,* 24*b* are in the immediate vicinity in such un-shielded direction to create noise and/or cross-talk in the pairs 24*p* of signal pin 24*a,* 24*b* in the bottom-most row.

Preferably, and as can be seen from FIGS. 1, 2, and 5, each ground shield 26 is generally identical to every other ground shield 26. Moreover, each ground shield 26 is symmetrical such that it can be placed adjacent a signal pin 24*a* or 24*b*. Accordingly, only one type of such ground shield 26 is necessary in constructing the header 10 of the first embodiment of the present invention. As best seen in FIGS. 2 and 5, each ground shield 26 is of a relatively simple design and in fact may be stamped from an appropriate sheet of conductive material into a final form by known forming and/or stamping processes. Alternatively, each shield 26 may be molded or extruded by known processes.

Preferably, the shroud 14 of the header 10 is molded from a suitable insulative material such as a high temperature plastic into a final form by known processes, where such final form includes defined apertures for each signal pin 24*a,* 24*b,* each ground shield 26, and each ground pin 28. Also preferably, each ground shield 26 is inserted into the base 16 of the shroud 14 from either the connector side or backplane side 22, preferably by mechanical means, and such ground shield 26 maintains an interference fit with such base 16 of such shroud 14. Preferably, the first or second wing 36*a,* 36*b* (the first wing 36*a* in FIGS. 2 and 5) of each ground shield 26 includes a bump 38*a* at a surface thereof to assist in maintaining the aforementioned interference fit of the ground shield 26 with the base 16 of the shroud 14.

Alternatively, each signal pin 24*a,* 24*b,* each ground shield 26, and/or each ground pin 28 may be over-molded in situ during formation of the base 16 and shroud 14. However, it is presently believed that such in situ over-molding may be excessively complicated when compared to other available manufacturing techniques.

Preferably, each ground pin 28 electrically contacts at least one ground shield 26 at the second wing 36*b* thereof. More preferably, and as shown in FIGS. 1 and 2, such contact occurs at the outer surface (the surface away from the associated signal pin 24*a,* 24*b*) of such second wing 36*b*. Preferably, every ground shield 26 electrically contacts a ground pin 28. Presumably, at some location, either in the complementary electrical connector, the mother board, or in another circuit, each ground pin 28 is electrically grounded. Accordingly, the ground shields 26 electrically contacted by the ground pins 28 are also grounded and are electrically coupled to one another. Although described up to now as rigid bumps 38*a,* 38*b,* other types of retention features may be employed without departing from the spirit and scope of the present invention. For example, one or both wings 36*a,* 36*b* in each ground shield 26 could include a compliant section (not shown) to retain such ground shield 26 in the base 16 of the shroud 14 and/or to retain an associated ground pin 28 in such base 16 of such shroud 14.

Preferably, and as best seen in FIGS. 2 and 4, each ground pin 28 includes a generally planar fin 40 that generally resides within the base 16 of the shroud 14 and that extends generally laterally from the main body of the ground pin 28. As seen in FIG. 1, the fin 40 extends generally in the second direction (arrow C), and has generally opposing planar sides 42 (FIGS. 2, 4). Accordingly, each ground shield 26 is electrically contacted by a ground pin 28 at a planar side 42 of the fin 40 of such ground pin 28.

Preferably, the ground pins 28 are arranged into a plurality of rows 30 that extend in the first direction (arrow R), and a plurality of columns 32*be,* 32*bi* that extend in the second direction (arrow C). As seen in FIG. 1, each row 30 of ground pins 28 corresponds to a row 30 of signal pin 24*a,* 24*b,* and each column 32*be,* 32*bi* of ground pins 28 alternates with a column 32*a* of pairs 24*p* of signal pins 24*a,* 24*b.* As seen, columns 32*be* of ground pins 28 are a pair of exterior or outer-most columns (left and right) and columns 32*bi* of ground pins 28 are at least one interior column (four are shown in FIG. 1) positioned between such exterior columns 32*be.* Preferably, each ground pin 28 in each interior column 32*bi* is positioned between and electrically contacts first and second ground shields 26 on either lateral side of such ground pin 28. As will be described below, each ground pin 28 in each interior column 32*bi* preferably contacts bumps 38*b* on wings 36*b* of such first and second ground shields 26. Also preferably, each ground pin 28 in each exterior column 32*be* is positioned adjacent and electrically contacts only a single ground shield 26 on one lateral side thereof.

In the case of a ground pin 28 in one of the interior columns 32*bi,* it is seen from FIG. 1 that the first ground shield 26 corresponding to such ground pin 28 is associated with a signal pin 24*a,* 24*b* of a first pair 24*p* of signal pins on one side of the ground pin 28 (the left side, for example), the second ground shield 26 is associated with a signal pin 24*a,* 24*b* of a second pair 24*p* of signal pin 24*a,* 24*b* on the other side of the ground pin 28 (the right side, to continue the example), and the first and second ground shields 26 electrically contact the ground pin 28 at either planar side of the fin 40 thereof. As seen, then, the first and second pairs 24*p* of signal pins 24*a,* 24*b* both reside in a row 30 that corresponds to the row 30 of the ground pin 28 at issue; more precisely, such ground pin 28 and such first and second pairs 24*p* of signal pin 24*a,* 24*b* can be considered to reside in a single row 30 (although not necessarily linearly aligned within the row 30). As also seen, such first and second pairs 24*p* of signal pins 24*a,* 24*b* respectively reside in immediately adjacent columns 32*a* on either side of the column 32*bi* of the ground pin 28 at issue.

In the case of a ground pin 28 in one of the exterior columns 32*be,* it is also seen from FIG. 1 that the single ground shield 26 corresponding to such ground pin 28 is associated with a signal pin 24*a,* 24*b* of a single pair 24*p* of signal pins on one side of such ground pin 28, and the single ground shield 26 electrically contacts the ground pin 28 at one planar side of the fin 40 thereof. Similar to the previous case, the single pair 24*p* of signal pins 24*a,* 24*b* resides in a row 30 corresponding to the row 30 of such ground pin 28. In this case, the single pair 24*p* of signal pins 24*a,* 24*b* resides in an immediately adjacent column 32*a* on only one side of the column 32*be* of such ground pin 28.

In either case, each ground pin 28 is preferably inserted into the base 16 of the shroud 14 from either the connector side or backplane side 20, 22 thereof, as with the ground shields 26. Such operation may be performed by appropriate automatic insertion machinery. Preferably, each ground pin 28 in the interior columns 32*bi* maintains an interference fit between contacted second wings 36*b* of the first and second ground shields 26, and more preferably between contacted bumps 38*b* on such second wings 36*b.* Correspondingly, it is preferable that each ground pin 28 in the exterior columns 32*be* interference fits between the contacted second wing 36*b* of the single ground shield 26 and with an interior surface of the base 16 (not shown) where such interior surface is opposite the contacted second wing 36*b* of the single ground shield 26. Preferably, and as best seen in FIGS. 2 and 5, each second wing 36*b* of each ground shield 26 includes a bump or bumps 38*b* at a contact surface thereof (the outer surface as shown in FIGS. 1, 2, and 5) to assist in electrically contacting the ground pin 28 at the fin 40 thereof, and to assist in maintaining the aforementioned interference fit.

As with the ground pins 28 and ground shields 26, each signal pin 24*a,* 24*b* is preferably inserted into the base 16 of the shroud 14 from either the connector side or backplane side 20, 22 thereof, and preferably maintains an interference fit with such base 16. Such insertion operation may be performed by appropriate automatic insertion machinery. More preferably, all of the aforementioned elements are inserted into the base 16 of the shroud 14 from the backplane side 22. As should be understood, the backplane side 22 is more readily accessible since it is not obstructed by any walls 18. Moreover, insertion from the backplane side 22 locks pins 24*a,* 24*b,* 28 in place upon securing the header 10 to the backplane 12. Preferably, and as seen in FIGS. 2 through 4, each signal pin 24*a,* 24*b* and each ground pin 28 preferably includes various contact surfaces that assist in maintaining an interference fit directly with the base 16 of the shroud 14.

Preferably, each signal pin 24*a,* 24*b* and each ground pin 28 includes a compliant section 44 exterior from the base 16 adjacent the backplane side 22 thereof, as best seen in FIGS. 2–4. As should be understood, each compliant section 44 maintains an interference fit with plated through holes in the backplane 12 when the header 10 is mounted thereto. As should be appreciated, it is undesirable to insert the compliant sections 44 into the base 16 of the shroud 14. Such compliant portions 44 may deform or likely would not easily fit through such base 16 during such insertion.

In one embodiment of the present invention, and referring again to FIG. 1, each signal pin 24*a,* 24*b* and each ground pin 28 in transverse cross-section is approximately 0.4 mm by 0.4 mm in width and height, in the region of the main pin portions that are received by the complementary electrical connector. Additionally, in such embodiment, each ground shield 26 has a main thickness of about 0.2 mm. Accordingly, if each signal pin 24*a,* 24*b* and each ground pin 28 in a row 30 is spaced about 1.0 mm in the first direction (arrow R), each signal pin 24*a,* 24*b* may be separated from its corresponding ground shield 26 by about 0.4 mm. Such distance is sufficient to provide a reasonable degree of structural integrity to the base 16 of the shroud 14.

Figure 6:
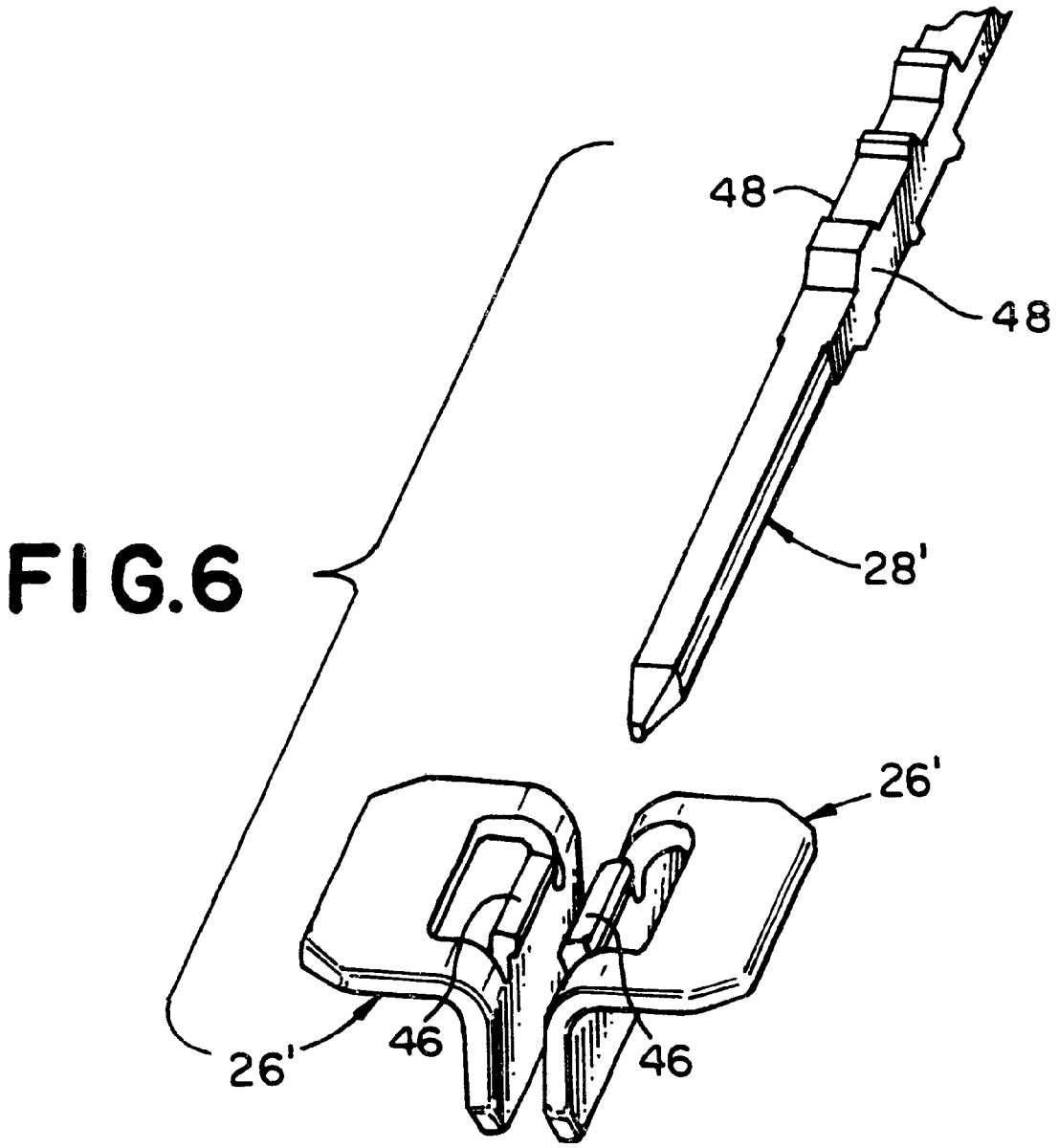
FIG. 6 is a perspective view showing a ground pin and a pair of ground shields in accordance with a second embodiment of the present invention.

Referring now to FIG. 6, it is seen that in a second embodiment of the present invention, each ground pin 28' does not have the fin 40 of the ground pin 28 (FIGS. 2 and 4), and each ground shield 26' does not have the contacting bump(s) 38*b* of the ground shield 26 (FIGS. 2 and 5). Instead, each ground shield 26' includes an integral tab 46 that contacts a contact portion 48 of the ground pin 28', where the contact portion 48 is generally in-line with respect to the longitudinally extending ground pin 28'. Preferably, the tab 46 is formed within the ground shield 26' by an appropriate stamping or molding operation, and the tab 46 is inclined slightly away from the main body of the ground shield 26' and toward the ground pin 28'. Accordingly, the tab 46 is urged into good electrical contact with the contact portion 48 when the ground pin 28' and the ground shield 26' are mounted to the base 16 of the shroud 14 (not shown in FIG. 6). As shown, the ground pin 28' is for an interior column 32*bi* since two ground shields 26' flank such ground pin 28'. Of course, only one ground shield 26' would flank the ground pin 28' if such ground pin 28' were in an exterior column 32*be*.

Figure 7:
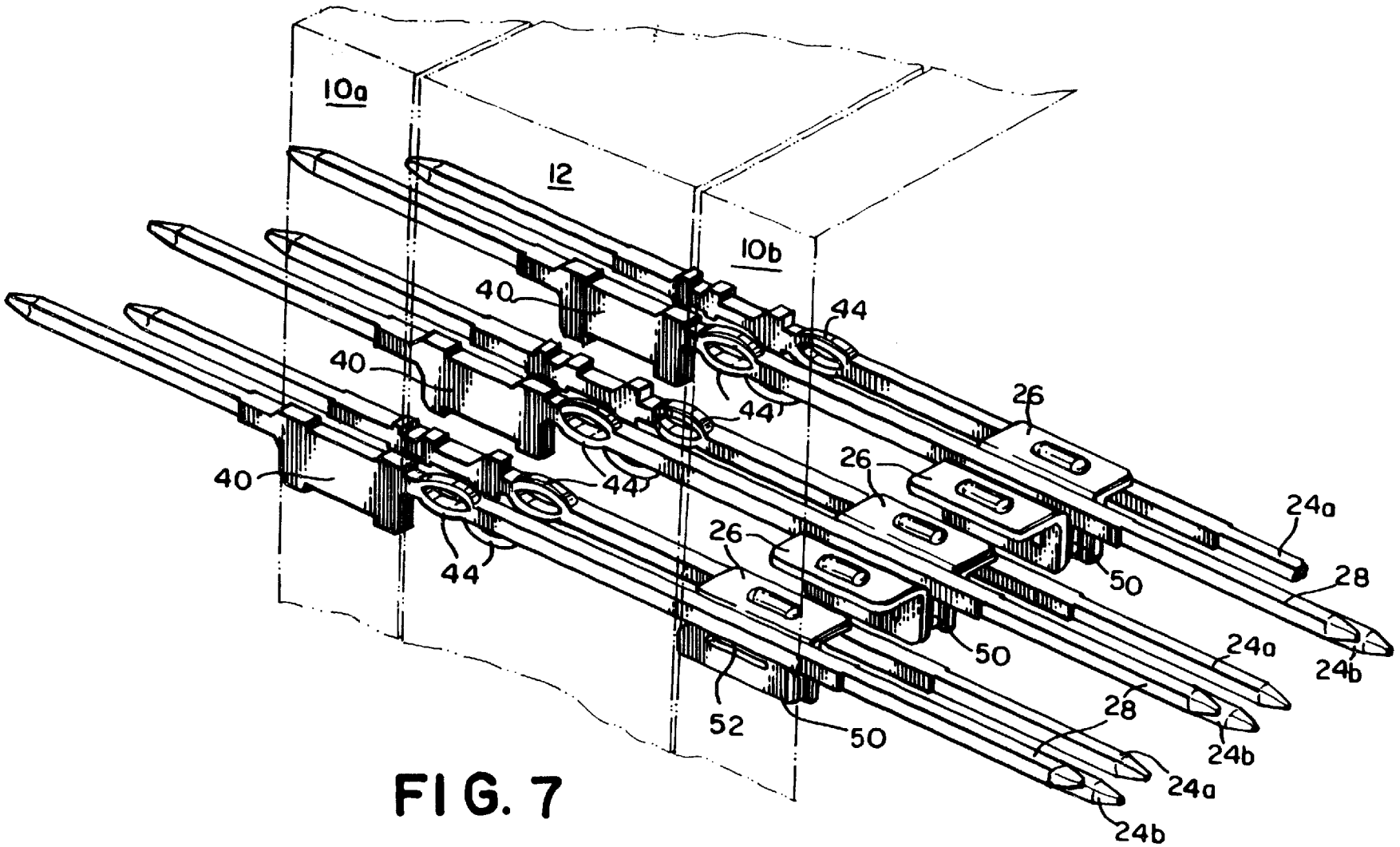
FIG. 7 is a perspective view similar to that of FIG. 2, but from a different angle, and shows a third embodiment of the present invention which is similar to the first embodiment as shown in FIGS. 1–5, wherein primary and secondary headers share common pins and sandwich the backplane therebetween.

Referring now to FIG. 7, it is seen that in a third embodiment of the present invention which is similar to the first embodiment as shown in FIGS. 1–5, a primary header 10*a* has pairs 24*p* of signal pins 24*a*, 24*b* and ground pins 28 that extend a relatively longer distance (as compared with the header 10 of FIGS. 1–5) beyond the backplane 12 than the header 10 shown in FIGS. 1–5. In addition, a secondary header 10*b* is positioned on the other side of the backplane 12 and generally opposite the primary header 10*a* such that the secondary header 10*b* receives and includes the extended portions of the pairs 24*p* of signal pins 24*a*, 24*b*. Accordingly, the backplane 12 is sandwiched between the primary and secondary headers 10*a*, 10*b*, each header 10*a*, 10*b* shares the pairs 24*p* of signal pins 24*a*, 24*b* and the ground pins 28, and a circuit board mounted to the primary header 10*a* is directly interfaced through the backplane 12 to another circuit board mounted to the secondary header 10*b*. Each header 10*a*, 10*b* has its own ground shields 26 (the ground shields 26 for the primary header 10*a* are not shown in FIG. 7). Unlike the primary header 10*a*, the secondary header 10*b* includes a plurality of securing contacts 50, where each securing contact 50 electrically contacts a respective ground pin 28 and secures such ground pin 28 to such header 10*b*. As seen, each securing contact 50 also electrically contacts at least one ground shield 26 within the secondary header 10*b* through bumps 38*b*, thereby electrically connecting the contacted ground shield(s) 26 with the contacted ground pin 28.

In particular, the primary header 10*a* of FIG. 7 is substantially identical to the header 10 of FIGS. 1–5, except that the pairs 24*p* of signal pins 24*a*, 24*b* and ground pins 28 extend a relatively longer distance as compared with the header 10 of FIGS. 1–5 to allow for rear plug-up. For example, in the header 10 of FIGS. 1–5, such pins 24*a*, 24*b*, 28 extend about 4.3 mm through and beyond the backplane 12, while in the primary header 10*a* of FIG. 7, such pins 24*a*, 24*b*, 28 extend about 19 mm through and beyond the backplane 12.

Preferably, each pin 24*a*, 24*b*, 28 is formed such that the distal end thereof (i.e., the end associated with the secondary header 10*b*) is substantially identical to the proximal end thereof (i.e., the end associated with the primary header 10*a*). Accordingly, the secondary header 10*b* is instantiated by way of a second shroud 14 substantially identical to the shroud 14 of the primary header 10*a*, where the second shroud 14 is slipped over the distal end of each pin 24*a*, 24*b*, 28 (FIG. 7A) after such pins are inserted through the backplane 12. As should be understood, the second shroud 14 is then moved toward the backplane 12 until the base 16 of such second shroud 14 is generally parallel to and in contact with such backplane 12. As viewed from their respective connector sides 20, then, the primary header 10*a* and the secondary header 10*b* each present substantially the same profile, pin arrangement, and 'footprint'. In fact, it is preferable that the primary header 10*a* and the secondary header 10*b* each be able to receive the same type of complementary electrical connector in their respective wells. Preferably, the primary edge 23 of the secondary header 10*b* is directly opposite the primary edge 23 of the primary header 10*a*, with respect to the backplane 12.

As was discussed above, and as similarly shown in FIGS. 2 and 4, each ground pin 28 in the primary header10a includes a generally planar fin 40 that generally resides within the base 16 of the shroud 14 of the primary header 10*a* and that extends generally laterally from the main body of the ground pin 28. As seen, each fin 40 has generally opposing planar sides such that each ground shield 26 in the primary header 10*a* is electrically contacted by a ground pin 28 at a planar side of the fin 40 of such ground pin 28. As was also discussed above, each ground pin 28 is preferably inserted into the shroud 14 of the primary header 10*a* such that the fm 40 maintains an interference fit therewith.

However, and as should be understood, the insertion of each ground pin 28 through the backplane 12 prevents such ground pin 28 from having a second fin on the distal end thereof. Accordingly, and as was discussed above, it is preferable that the secondary header 10*b* include a plurality of securing contacts 50, where each securing contact 50 contacts a respective ground pin 28, secures such ground pin 28 to such header 10*b*, electrically connects such ground pin 28 to at least one ground shield 26 (through bumps 38*b*), and in effect performs the same function as a fin 40.

Figure 7B:
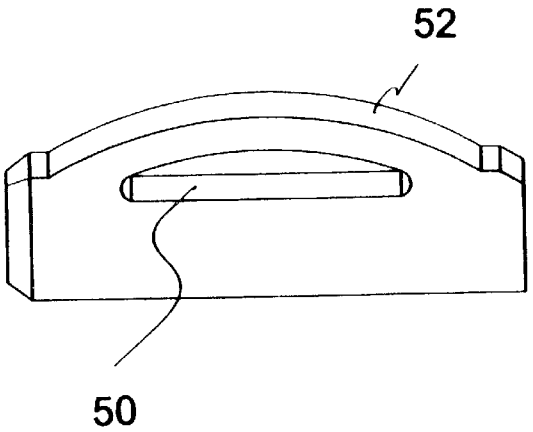
FIG. 7B is a perspective view showing a securing contact employed in connection with the secondary header of FIG. 7.

In particular, it is preferable that, prior to being mounted to the backplane 12 and the pins 24*a*, 24*b*, 28, the second shroud 14 be fitted with a plurality of conductive securing contacts 50, where one contact 50 is in each space in the base 16 of the second shroud 14 where a second fin of a ground pin 28 would otherwise reside. The insertion of contacts 50 is generally similar to the insertion of shields 26 into the base 16. As seen in FIG. 7B, each such securing contact 50 has generally opposing planar sides, and as positioned in the second shroud 14 of the secondary header 10*b* is electrically contacted on at least one side by a ground shield 26 in the secondary header 10*a* at a planar side of such securing contact 50.

Figure 7C:
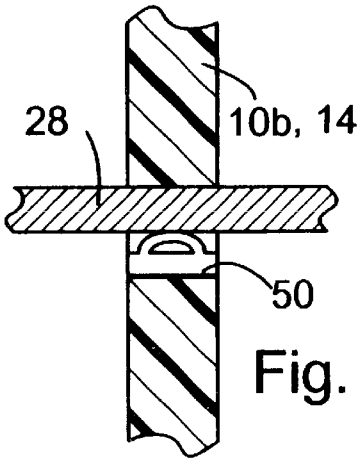
FIG. 7C is a cross-sectional view of a portion of the secondary header, an intermediate ground contact, and a portion of an inserted ground contact of FIG. 7.
Figure 7A:
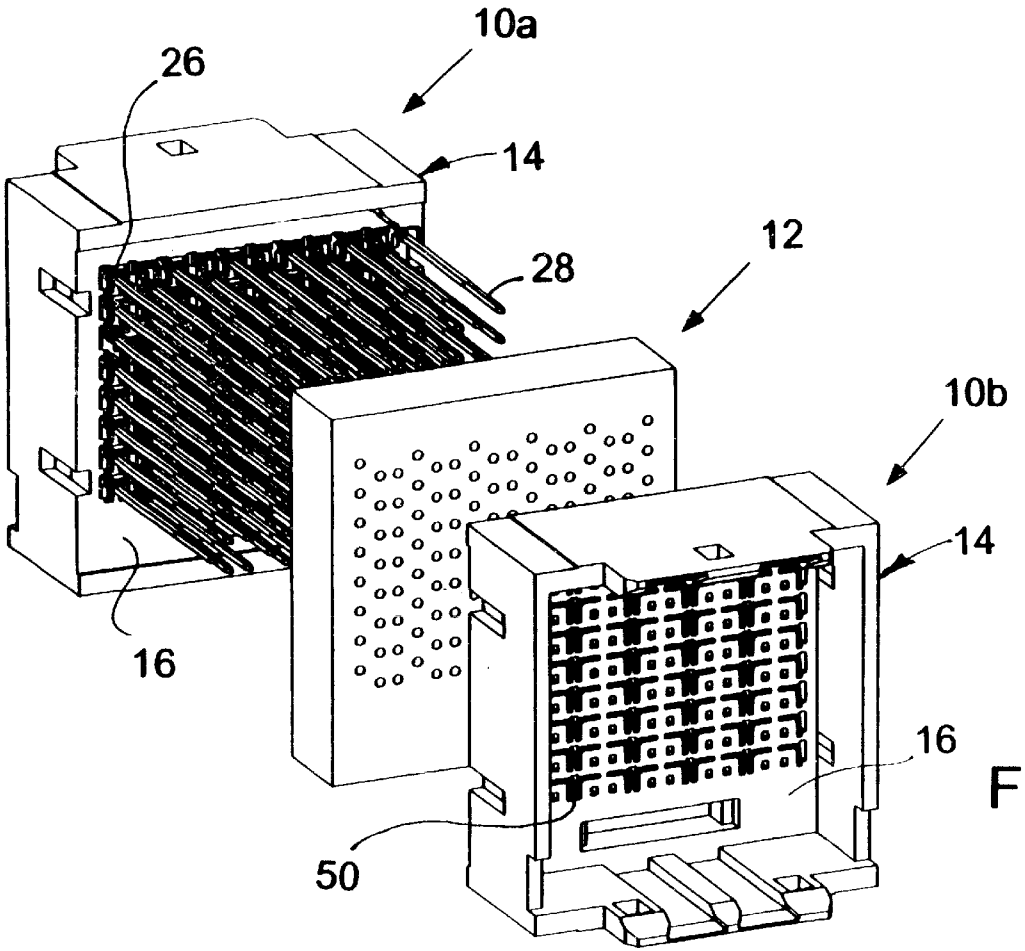
FIG. 7A is an exploded perspective view showing the primary header, backplane, and secondary header of FIG. 7.

When the second shroud 14 is slipped over the distal end of each pin 24*a*, 24*b*, 28 and moved toward the backplane 12, then, each securing contact 50 in such second shroud 14 securingly electrically contacts the side of a respective ground pin 28 and maintains an interference fit therewith, as is best seen in FIG. 7C. Preferably, each securing contact 50 includes a compliant or spring portion 52 in facing relation to the side of the respective ground pin 28 to assist in securingly electrically contacting the respective ground pin 28 and maintaining the interference fit therewith. As with the fin 40, each securing contact 50 engages bumps 38*b* on the contacted-to ground shields 26. However, any other appropriate mechanism may be employed to perform such functions without departing from the spirit and scope of the present invention.

With such securing contacts 50 acting as intermediate ground shields, the ground shields 26 in the second shroud 14 are electrically coupled to the ground pins 28. In addition, the entire second shroud 14 is secured to the backplane 12. The interference fit between the securing contacts 50 and the ground pins 28 secures the second shroud 14 to the backplane 12.

In the foregoing description, it can be seen that the present invention comprises a new and useful header 10 for being mounted to a circuit substrate such as a backplane 12. The header 10 can have multiple differential signal pairs 24*p* in relatively high density, and ground shields 26 for each pair 24*p* such that each pair 24*p* of signal pins 24*a*, 24*b* is shielded from every other pair 24*p* of signal pins 24*a*, 24*b* by such ground shields 26. Moreover, the header is practical and relatively easily manufactured. It should be appreciated by those skilled in the art that changes could be made to the embodiments described above without departing from the inventive concepts thereof. It is understood, therefore, that this invention is not limited to the particular embodiments disclosed, but it is intended to cover modifications within the spirit and scope of the present invention as defined by the appended claims.

What is claimed is:

1. An electrical connector body, comprising:

a base;

a plurality of apertures in said base for securing contacts to said base;

a plurality of ground shields residing within said base;

ground pins and signal pins disposed within corresponding apertures in said base to form a header connector; and ground shields disposed within corresponding apertures in the base, adjacent ones of the ground shields being disposed in opposite orientations, said ground pins each having a fin for engaging said ground shield.

2. An electrical connector body, comprising:

a base;

a plurality of apertures in said base for securing contacts to said base;

a plurality of ground shields residing within said base; ground pins and signal pins disposed within corresponding apertures in said base to form a header connector; and ground shields disposed within corresponding apertures in the base, adjacent ones of the ground shields being disposed in opposite orientations, one of said ground pins engaging adjacent ground shields, each of said adjacent ground shields having a projection extending towards the other adjacent ground shield, and the projection being a protuberance on a surface of said ground shield.

3. An electrical connector body, comprising:

a base;

a plurality of apertures in said base for securing contacts to said base; and a plurality of generally L-shaped first ground shields residing within said base;

adjacent ones of the first ground shields being disposed in opposite orientations, the electrical connector body further comprising a plurality of generally planar second, intermediate ground shields, each of said second, intermediate ground shields disposed between and in electrical contact with said adjacent ones of the first ground shields.

4. A header, comprising:

a body;

a plurality of signal pins extending from said body; and a plurality of generally L-shaped ground shields within said body, each ground shield associated with a corresponding one of said signal pins, said signal pins being arranged in columns, and said ground shields being arranged in columns, and two immediately adjacent columns of said signal pins being flanked on both sides by two immediately adjacent columns of said ground shields.

5. A header, comprising:

a body;

a plurality of signal pins extending from said body;

a plurality of generally L-shaped ground shields within said body, each sound shield associated with a corresponding one of said signal pins; and ground pins extending through said body, each ground pin corresponding to at least one of said ground shields, the header further comprising a plurality of intermediate ground shields within said body, each intermediate ground shield contacting a corresponding one of said ground shields and a corresponding one of said ground pins to connect said ground pin to said ground shield.

6. A header, comprising:

a body;

a plurality of signal pins extending from said body;

a plurality of generally L-shaped ground shields within said body, each ground shield associated with a corresponding one of said signal pins; and ground pins extending through said body, each ground pin corresponding to at least one of said ground shields and at least some of said ground pins corresponding to two ground shields, wherein said ground pins are interstitially arranged relative to said signal pins.

7. A header, comprising:

a body;

a plurality of ground shields in said body;

a plurality of receiving areas located between adjacent ground shields;

a plurality of ground pins extending through said body, each having a longitudinal portion generally offset from said receiving area; and a plurality of conductive elements, each disposed within said receiving area for connecting a corresponding one of said ground pins to a corresponding one of said ground shields.

8. The header as recited in claim 7, wherein said conductive element is a part of said ground pin extending transverse to said longitudinal portion.

9. The header as recited in claim 7, wherein said conductive element is an intermediate ground shield.

10. A header system mountable to a circuit substrate having first and second opposed sides, comprising:

a first header positionable on said first side of said circuit substrate and including:

a body;

a plurality of ground shields in said body; and a plurality of apertures in said body; and a second header positionable on said second side of said circuit substrate and including:

a body;

a plurality of ground shields in said body;

a plurality of intermediate ground shields in said body, each corresponding to and contacting at least one of said ground shields; and a plurality of apertures in said body; and a plurality of ground pins, each extending through a corresponding one of said apertures in said first and second header bodies and contacting at least one of said ground shields in said first header and one of said intermediate ground shields in said second header and adapted to pass through said circuit substrate.

11. The header system as recited in claim 10, further comprising signal pins, each extending through corresponding through a corresponding one of said apertures in said first and second header bodies.

12. The header system as recited in claim 11, wherein said signal pins are arranged in columns, said ground shields are arranged in columns and said columns of said ground shields are positioned between adjacent columns of said signal pins.

13. The header system as recited in claim 12, wherein two columns of signal pins flank each side of two columns of ground shields.

14. The header system as recited in claim 13, wherein said ground pins each comprise:

a longitudinally extending section for contacting said intermediate ground shield in said second header; and a transverse section extending from said longitudinally extending section for contacting said ground shield in said first header.

15. A differential pair header connector, comprising:

a housing;

a plurality of signal contacts passing through the housing, the signal contacts arranged in columns, wherein pairs of columns are arranged immediately adjacently to define differential pairs of signal contacts;

a plurality of ground shields in the housing and located between adjacent columns of the signal contacts, each shield comprising:

a first section extending along the adjacent columns of signal contacts to shield the adjacent columns of contacts; and a second section extending between adjacent signal contacts within one of the columns of contacts to shield the adjacent signal contacts; and a plurality of ground contacts passing through the housing, each ground contact engaging one of the ground shields.

16. The header of claim 15 wherein at least one column of ground shields is located between adjacent rows of contacts.

17. The header of claim 16 wherein the at least one column of ground shields comprises two columns of ground shields.

* * * * *